US008162026B1

(12) United States Patent
Lundahl

(10) Patent No.: US 8,162,026 B1
(45) Date of Patent: Apr. 24, 2012

(54) AUXILIARY SPRING MULTIPLE REVOLUTION CLUTCH DEVICE

(75) Inventor: Karl Harvey Lundahl, Stanchfield, MN (US)

(73) Assignee: Industrial Spring Company, Coon Rapids, MN (US)

( * ) Notice: Subject to any disclaimer, the term of this patent is extended or adjusted under 35 U.S.C. 154(b) by 150 days.

(21) Appl. No.: 12/730,543

(22) Filed: Mar. 24, 2010

Related U.S. Application Data

(60) Provisional application No. 61/211,299, filed on Mar. 26, 2009.

(51) Int. Cl.
*E05F 11/00* (2006.01)

(52) U.S. Cl. ..... 160/191; 160/192; 160/317; 160/318; 160/189; 242/372

(58) Field of Classification Search ..... 160/191, 160/192, 317, 201, 305, 318, 291, 294, 296, 160/292, 189, 323.1, 293.1; 242/372
See application file for complete search history.

(56) References Cited

U.S. PATENT DOCUMENTS

| | | | | |
|---|---|---|---|---|
| 1,889,639 | A * | 11/1932 | Cotton | 160/305 |
| 4,803,855 | A * | 2/1989 | Kennedy | 68/23.7 |
| 4,993,657 | A * | 2/1991 | Brown | 242/372 |
| 5,460,216 | A * | 10/1995 | Hirao et al. | 160/133 |
| 7,967,051 | B2 * | 6/2011 | Diaz | 160/188 |
| 2008/0196844 | A1 | 8/2008 | Diaz | |
| 2009/0051187 | A1 * | 2/2009 | Biecker | 296/37.16 |

* cited by examiner

*Primary Examiner* — Blair M. Johnson
(74) *Attorney, Agent, or Firm* — James L. Young; Westman, Champlin & Kelly, P.A.

(57) ABSTRACT

A spring assembly is provided for an upward acting door that travels on a travel path while opening. The assembly includes a shaft, a torsion spring and a second spring. The torsion spring is connected to the shaft and provides a lifting force for the door throughout the travel path. The second spring is connected to the shaft and provides a lifting force for the door during only a portion of the travel path. In another aspect, a spring assembly is provided for an upward acting door that travels on a travel path while closing. The torsion spring is connected to the shaft and provides a weight supporting force for the door throughout the travel path. The second spring is connected to the shaft and provides a weight supporting force for the door during only a portion of the travel path.

12 Claims, 8 Drawing Sheets

AUXILIARY SPRING MULTIPLE REVOLUTION CLUTCH DEVICE

BACKGROUND

A typical garage door generally has multiple door panel sections (hinged together) that roll upward on parallel side tracks to move from a closed, vertical position to an open, horizontal, overhead position. A torsion spring connected to a shaft line supplies the power to balance the door throughout the opening operation. The spring generally has constant power per inch of rotation of the spring and travel of the door. However, some doors have a top door panel section that is heavier than the other sections; for example, some doors have windows or other ornamental features only on the top door panel section. With such doors having a heavy top door panel section, the loss of weight per inch of travel during opening is not constant. Accordingly, conventional door opening systems do not balance the uneven weight distribution.

Typically, the installation of a "top-heavy" door falls into one of two categories. In the first alternative, a spring lifting force is slightly less than optimal at the beginning of the door opening path but is sufficient once the heavy top door panel section has been lifted onto the horizontal track. This arrangement may strain the door lift motor, leading to premature wear and failure. In a second scenario, there is sufficient lifting force at the beginning of the opening process, but then there is excess force once the heaviest top door panel section has been lifted. This excess force may strain the attachment components securing the door to the garage, thereby leading to loosening of the attachments over time.

SUMMARY

In one aspect, a spring assembly is provided for an upward acting door that travels on a travel path while opening. The assembly comprises a shaft, a torsion spring and a second spring. The torsion spring is connected to the shaft and provides a lifting force for the door throughout the travel path. The second spring is connected to the shaft and provides a lifting force for the door during only a portion of the travel path.

In another aspect, a spring assembly is provided for an upward acting door that travels on a travel path while closing. The assembly comprises a shaft, a torsion spring and a second spring. The torsion spring is connected to the shaft and provides a weight supporting force for the door throughout the travel path. The second spring is connected to the shaft and provides a weight supporting force for the door during only a portion of the travel path.

This Summary is provided to introduce a selection of concepts in a simplified form that are further described below in the Detailed Description. This Summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure is referred to by like reference numerals throughout the several views.

Figure 1:
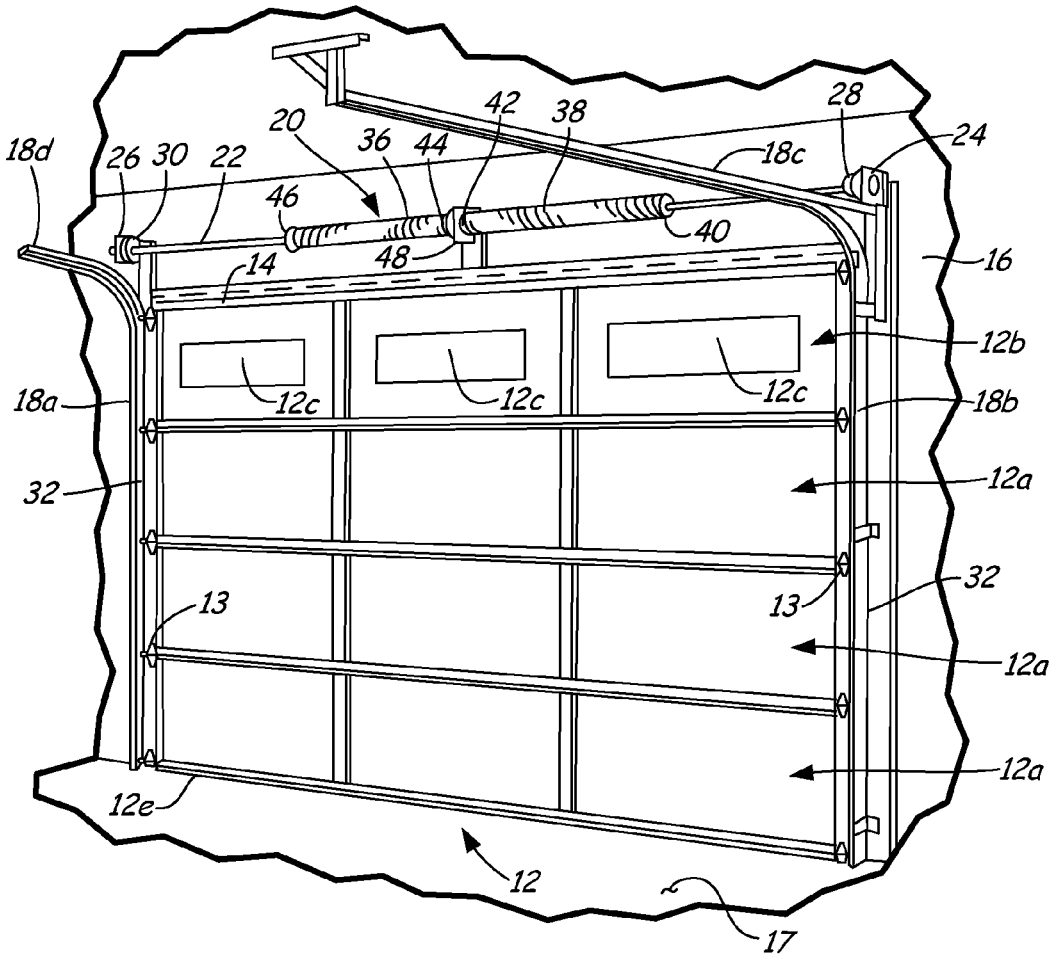
FIG. 1 PRIOR ART
FIG. 1 is a perspective view of a sectional upward acting door including a prior art torsion spring counterbalance system.

While the above-identified figures set forth one or more embodiments of the disclosed subject matter, other embodiments are also contemplated, as noted in this disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. Moreover, where directional terms (such as above, over, left, right, under, below, etc.) are used with respect to the illustrations or in the discussion, they are used for ease of comprehension only and not as limitations. The elements of the devices may be oriented otherwise, as readily appreciated by those skilled in the art.

DETAILED DESCRIPTION

The present disclosure is directed to an improved counterbalance system and method for counterbalancing sectional and other upward acting doors. The disclosed subject matter overcomes the problems associated with counterbalancing doors having door panel sections or portions thereof that are of different weights. In particular, the disclosed subject matter is useful with upward acting doors having a top portion that is heavier than its lower portion. Such portions may consist of one or more door sections.

Sectional upward acting garage doors with multiple horizontal door panel sections are ubiquitous. A longstanding problem in the use of such garage doors is the provision of a suitable counterbalance system for counterbalancing the weight of the door when it moves between open and closed positions. Ideally, a motorized operator or a human user of the door needs to exert little force when moving the door between open and closed positions. To this end, upward acting sectional doors have typically been provided with counterbalance mechanisms such as torsion coil springs operably engaged with an elongated shaft mounted generally above the door. Spaced-apart cable drums are mounted on opposite ends of the shaft and are connected to the door at the lowermost section by elongated flexible cables, which are wound onto and off of the drums as the door is moved between the open and closed positions. Counterbalance forces are provided by adjusting the torsional windup of the torsion spring or springs. Generally, a sectional door where the section weights are similar can be substantially counterbalanced by a conventional torsion spring counterbalance mechanism as described herein and well known to those skilled in the art.

However, sectional garage doors may be subjected to many modified design features, including relatively thick or heavy glass windows, ornamental features and additional structural or reinforcing components, which result in sectional doors wherein the respective door panel sections are of unequal weight. In cases where the weights of the door panel sections are not essentially equal, the effective door weight as the door travels between open and closed positions is difficult to counterbalance by using conventional torsion spring counterbalance mechanisms.

FIG. 1 illustrates a prior art sectional upward acting garage door 12 covering an opening 14 in a vertical wall 16, wherein the opening extends to a floor 17. A typical sectional upward acting door, such as door 12, is made up of multiple door panel sections 12*a* and 12*b* that are interconnected by suitable hinges 13. Door 12 is guided for movement on a travel path between the closed position shown and an open position on spaced apart guide tracks, each guide track including substantially vertical tracks 18*a*, 18*b* and horizontal tracks 18*c*, 18*d*, interconnected by curvilinear portions in a conventional manner. Door 12 may also be operably connected to a motorized operator, not shown, for moving the door between open and closed positions.

As illustrated in FIG. 1, door panel sections 12*a* and 12*b* are of unequal weight. For example, uppermost door panel section 12*b* of the door 12 is shown to include multiple windows 12*c*, which increase the weight of door panel section 12*b* versus the three remaining door panel sections 12*a*. Accordingly, when door 12 moves between open and closed positions, the effective force on the moving door varies. This variation will be different and more severe for doors that have door panel sections of unequal weight. In the past, sectional doors of uneven weight have been modified by, for example, adding weight to the lowermost door panel section 12*a* to compensate for added weight of a heavier uppermost door panel section 12*b*. However, this form of modification uses additional materials and labor, and the added weight may require the use of a more powerful and more expensive motor.

Sectional door 12 includes a counterbalance mechanism, generally designated by the numeral 20, comprising an elongated shaft 22 supported for rotation between spaced apart support brackets 24 and 26. Brackets 24 and 26 are suitably mounted on wall 16 for supporting the shaft 22. Shaft 22 supports opposed cable drums 28 and 30 for rotation. As drums 28 and 30 rotate with shaft 22, elongated flexible cables 32 wind onto and unwind from drums 28 and 30. Ends of elongated flexible cables 32 are connected to opposed side edges of the lowermost door panel section 12*a*, typically adjacent a bottom edge 12*e* of that lowermost door panel section 12*a*, by a suitable connector.

Counterbalance forces are exerted on door 12 by cables 32 under the influence of opposed torsion coil counterbalance springs 36 and 38, which are sleeved over the shaft 22 and are connected at their opposite ends to spring winding or anchor cones 40, 42, 44 and 46. Spring anchor cones 42 and 44 are fixably mounted and connected to a support bracket 48, which is also mounted on wall 16. Opposing spring winding cones 40 and 46 are clamped to shaft 22 for rotation therewith (e.g., affixed to the shaft 22 by suitable fasteners, such as setscrews). The fasteners may be loosened so that the torsional windup of the springs 36 and 38 may be adjusted selectively to counterbalance the weight of door 12 in a known manner.

The present disclosure is directed to an auxiliary torsion spring attached to the shaft to offer supplemental lifting at the beginning of a garage door lifting operation. This helper spring is particularly useful for a garage door that has a top door panel portion that is heavier than its lower door panel portion. A door part or portion may consist of one or more sections. It is to be understood that where door sections are discussed, the discussion is also applicable to parts or portions consisting of fewer than one, one, or more than one door section. The helper spring counter-acts the additional weight of the heavy top door portion and offers additional lift at least until the heavy top door portion is lifted up so that its weight is transferred to the horizontal tracks 18*c*, 18*d* of the guide tracks. Thereafter, the auxiliary spring 54 becomes inactive but still freely rotates with the shaft throughout the travel of the door as it opens. This allows for a well-balanced door and lifting mechanism throughout the door's travel path, from a closed vertical position to an open horizontal position, thereby reducing stress on the door opener motor. Moreover, when the door 12 is closed from the open position, the auxiliary spring supports the additional weight of the heavy top door portion as it is lowered onto the vertical tracks 18*a*, 18*b* of the guide tracks, preventing the door 12 from slamming onto the floor. In an exemplary embodiment, auxiliary spring assembly 52 provides approximately thirty pounds of boost or support. In other embodiments, auxiliary spring assembly 52 provides between approximately one pound and approximately 75 pounds of boost or support.

Figure 2:
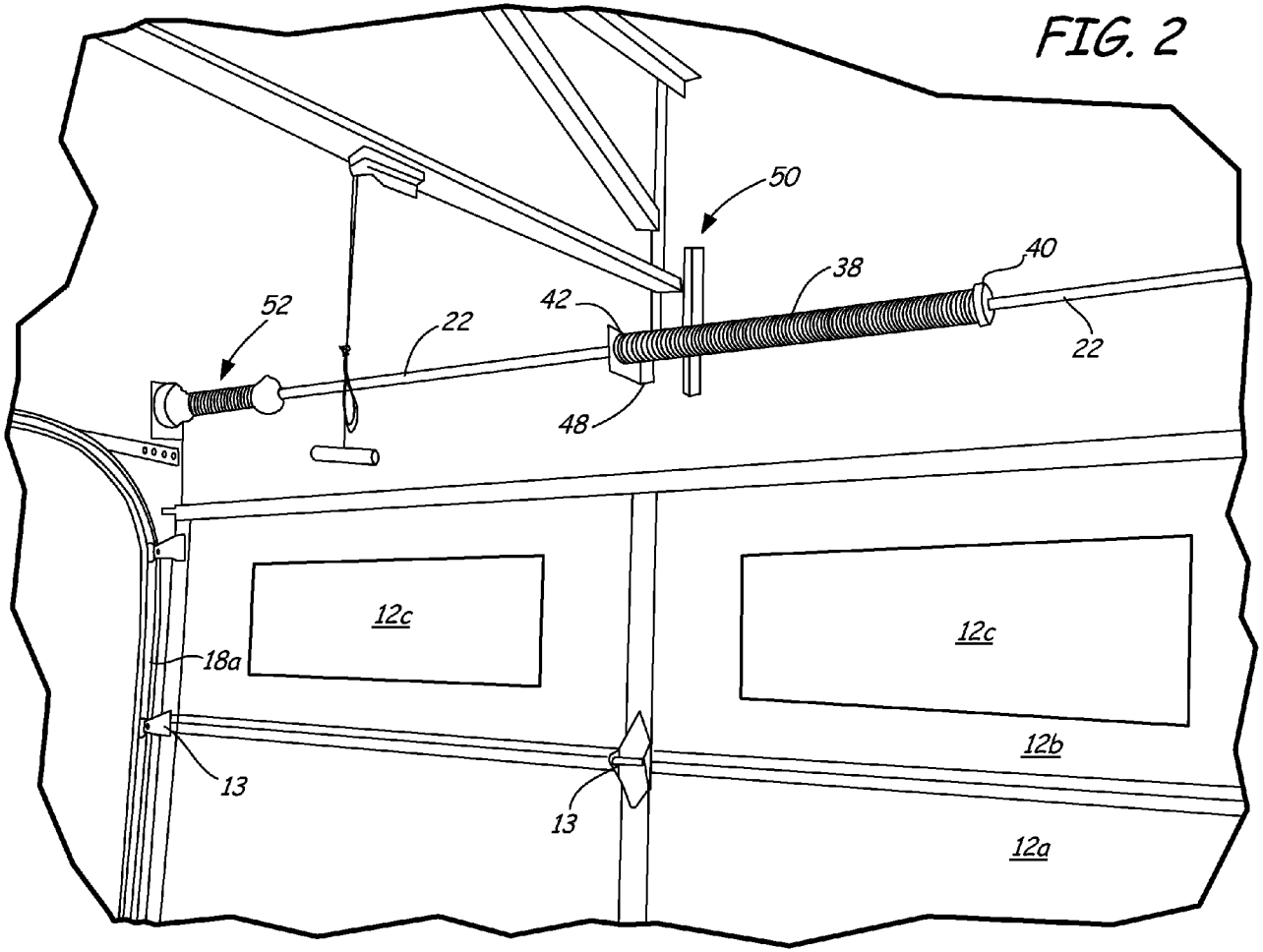
FIG. 2 is a perspective view of an exemplary embodiment of a torsion spring counterbalance system of the present disclosure.

FIG. 2 shows a counter balance assembly 50 in accordance with an exemplary embodiment of the present disclosure. In an exemplary embodiment of counter balance assembly 50, only one primary torsion coil counter balance spring 38 is used. In addition to primary torsion coil counter balance spring 38, shaft 22 carries auxiliary spring assembly 52. In an exemplary embodiment, torsion spring 38 provides a lifting force for door 12 throughout its travel path while opening and provides a weight supporting force for door 12 throughout its travel path while closing. In contrast, an auxiliary spring of spring assembly 52 provides a lifting force for door 12 only during a portion (e.g., during travel of the door over an initial segment, such as approximately the first three feet) of its travel path while opening and provides a weight supporting force for door 12 only during a portion (e.g., during travel of the door over a final segment, such as the last three feet) of its travel path while closing.

Figure 3:
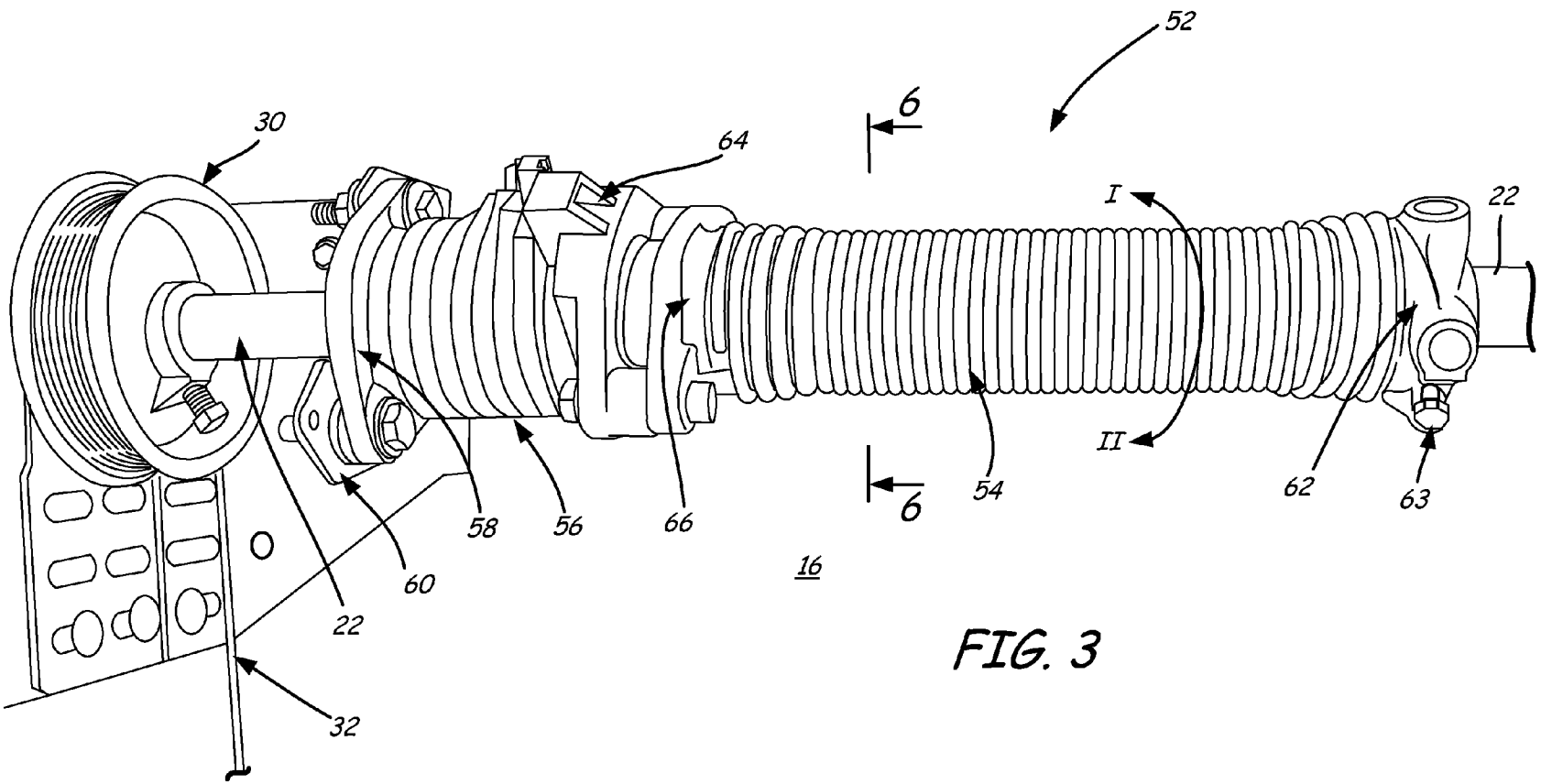
FIG. 3 is a perspective view of an exemplary auxiliary spring assembly of the present disclosure.

As shown in FIG. 3, auxiliary spring assembly 52 includes auxiliary torsion spring 54 and disc clutch assembly 56. Base 58 of disc clutch assembly 56 is fixedly attached to bracket 60, which is in turn fixedly attached to the vertical wall 16.

In an exemplary embodiment, auxiliary spring 54 is installed as follows. With door 12 in a closed position, auxiliary spring 54 is wound up about shaft 22 in the direction of arrow I. Depending upon the particular door and application, the required number of turns of auxiliary spring 54 to lift top section 12*b* to the horizontal tracks 18*c*, 18*d* is typically from about one turn to about six turns. Then, winding cone 62 of auxiliary spring 54 is fixed to shaft 22 by suitable fasteners (such as by setscrews 63), so that when shaft 22 rotates, so does winding cone 62. When door 12 is opened, auxiliary spring 54 lifts the extra weight of door panel section 12*b* as auxiliary spring 54 releases its tension by rotating in the direction of arrow II. Once the required rotations in direction II have been completed, door panel section 12*b* in an exemplary embodiment will have been lifted sufficiently so that the section 12*b* moves from the vertical path to the horizontal path (i.e., its weight is now supported on horizontal tracks 18*c*, 18*d*). Because an end of auxiliary spring 54 is fixed to rotating shaft 22 at spring winding cone 62, auxiliary spring 54 continues to rotate in direction II, even when it no longer provides a lifting force. At that point, disc clutch assembly 56 allows auxiliary spring 54 to freely rotate about shaft 22 as primary torsion coil counterbalance spring 38 (see FIG. 2) continues to lift the remaining door panel sections 12*a* of door 12 (see FIG. 1).

Figure 4:
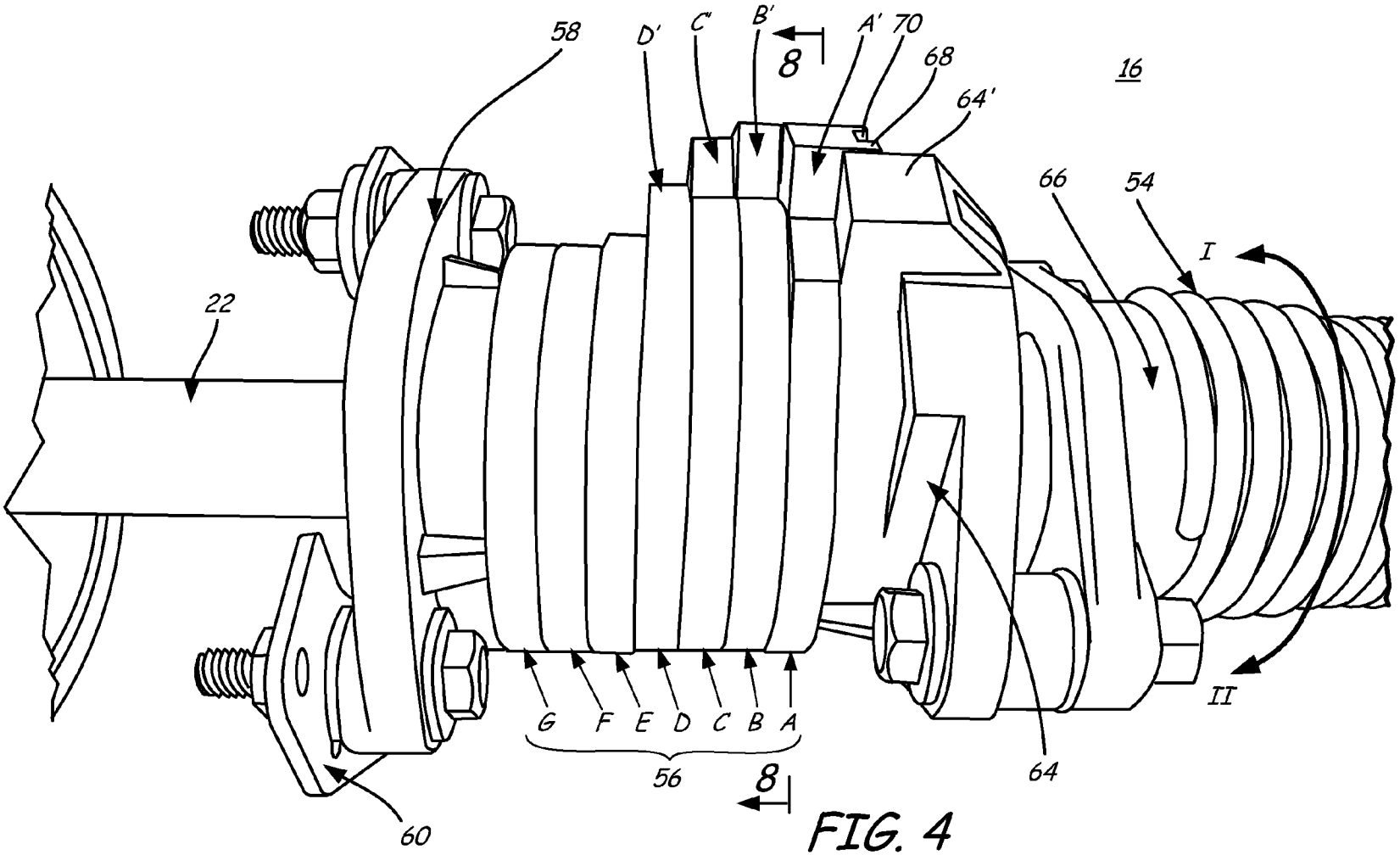
FIG. 4 is a closer view of the disc clutch portion of the auxiliary spring assembly of FIG. 3.

As shown in FIG. 4, in an exemplary embodiment, the auxiliary spring assembly 52 comprises an auxiliary torsion spring 54 and a plurality of clutch discs A-G arranged in a stacked series along the shaft 22. In one embodiment, a disc may freely rotate about 340°-350° before locking up with an adjacent disc for coupled rotation. Thus, for example, for a device with 10 discs, a combined rotation of 3,400°-3,500° is possible before the device is locked in that one direction of rotation. For a device with seven discs, a combined rotation of 2,380°-2,450° is possible before the device is locked in that one direction of rotation. The portion of the door's travel during which auxiliary spring 54 provides a lifting or weight supporting force—that is, the portion of the door's travel during which the auxiliary spring 54 experiences tension—is adjustable. Such adjustment is accomplished by varying the number of rotations of auxiliary spring 54 during installation and/or varying the number of clutch discs provided. Thus, the auxiliary spring installation can be customized for the needs of a particular door. For example, some doors are taller and therefore require more rotations of the cable drums 28/30 for opening and closing. Moreover, sizes of cable drums 28/30 can vary, thereby leading to changes in the requisite number of spring rotations. Further, with some applications, it may be desirable for the auxiliary spring to be active to lift a larger or smaller portion of the door than that corresponding to a single door section 12*b*.

FIG. 4 is a view of an exemplary disc clutch assembly 56. One end of auxiliary spring 54 is fixedly attached to disc clutch assembly 56 at spring anchor cone 66 and end disc 64. End disc 64 is fixed to first clutch disc A having tab A'. The illustrated clutch disc assembly 56 has seven clutch discs labeled A-G, each having a corresponding tab A'-G'. In an exemplary embodiment, tab B' of clutch disc B has an axially extending portion 68 that contacts tab A' of adjacent clutch disc A (see FIGS. 4, 5 and 7B). The tabs C'-G' of the remaining clutch discs are similarly configured (e.g., see FIGS. 4 and 5).

Figure 5:
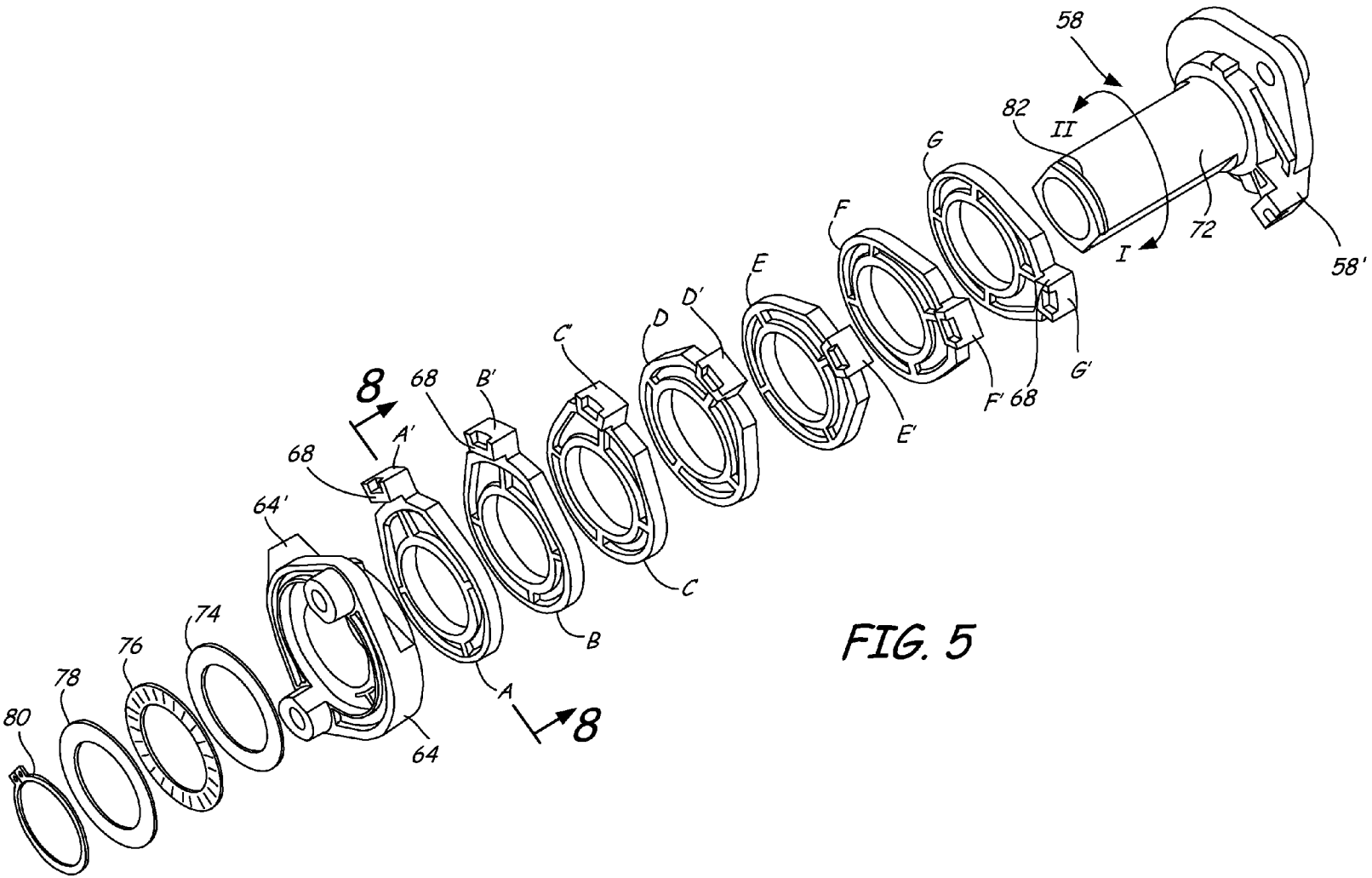
FIG. 5 is an exploded perspective view of the disc clutch assembly, as viewed from the back compared to FIG. 4.

FIG. 5 is an exploded perspective view of the disc clutch assembly 56, as viewed from the back (relative to the view of FIG. 4). In the embodiment shown in FIG. 5, disc clutch assembly 56 has seven clutch discs A-G. In an exemplary embodiment, anchor cone 66 (shown in FIG. 4) is part of auxiliary spring 54 rather than part of clutch assembly 56. In the illustrated embodiment, anchor cone 66 and end disc 64 are bolted together for coupled rotation (about shaft 22).

Shaft 72 of base 58 carries clutch discs A-G, end disc 64, bearing race 74, needle bearing 76, and bearing race 78. Snap ring 80 snaps into groove 82 of shaft 72 to hold disc clutch assembly 56 together axially.

Figure 6:
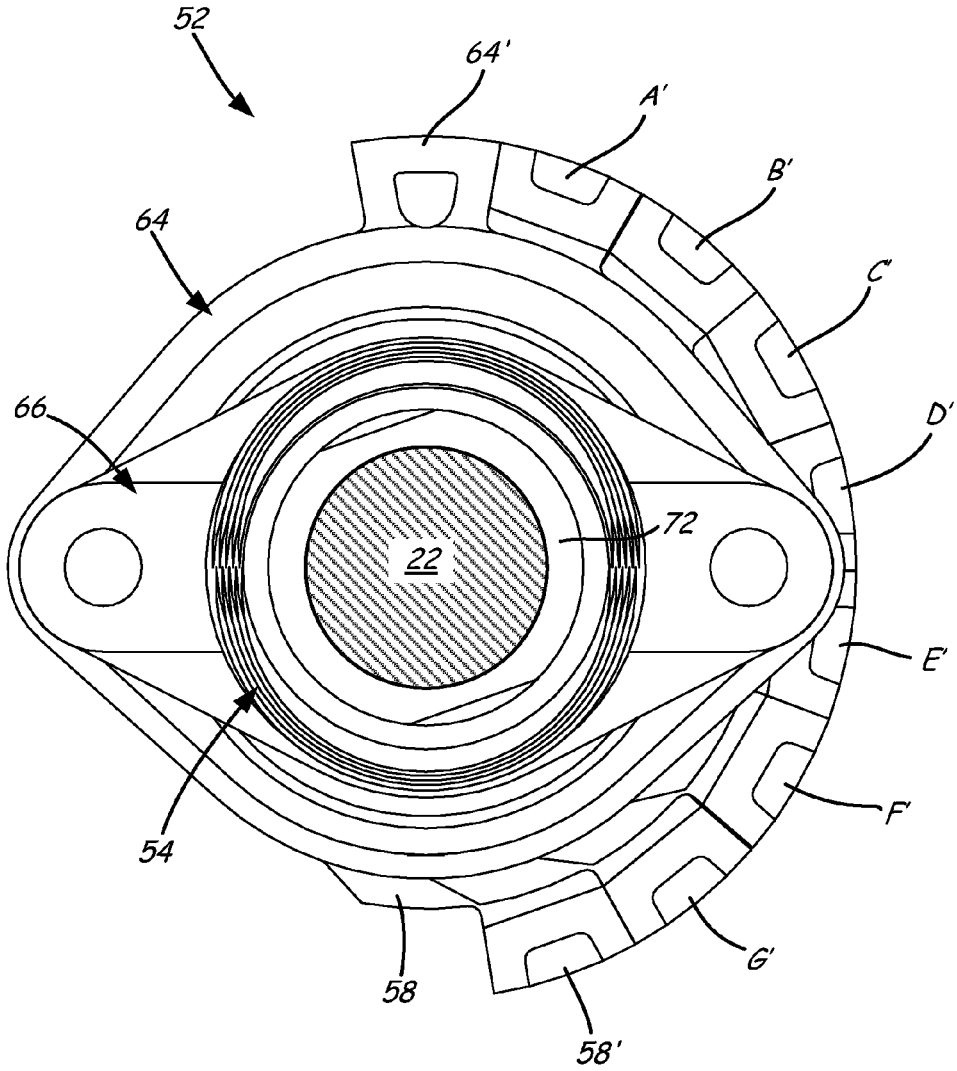
FIG. 6 is an end view of an exemplary auxiliary spring assembly, as viewed from the vantage point indicated by line 6-6 in FIG. 3.
Figure 7A:
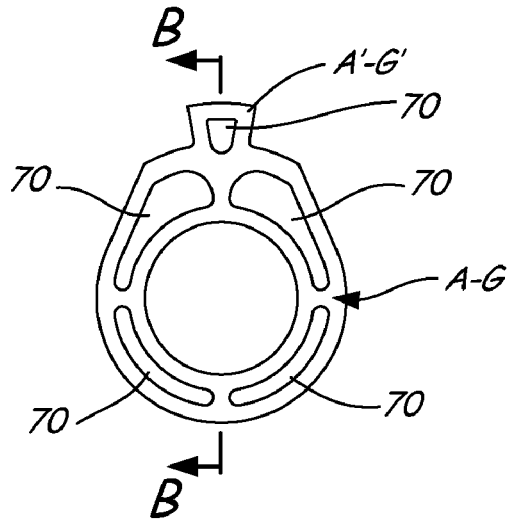
FIG. 7A is a front view of one exemplary embodiment of a disc clutch plate.
Figure 7B:
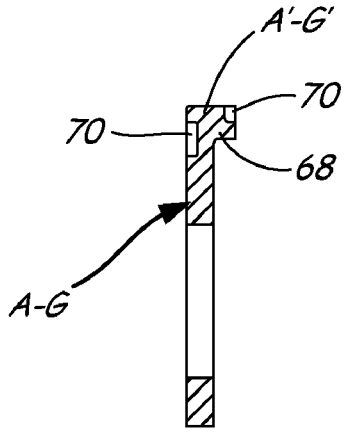
FIG. 7B is a cross-sectional side view of the disc clutch plate of FIG. 7A, taken through line B-B.

FIG. 6 is an axial view of auxiliary spring assembly 52, taken from line 6-6 of FIG. 3. FIG. 7A is an axial front view of one exemplary embodiment of a clutch disc A-G. FIG. 7B is a cross-sectional side view of the clutch disc of FIG. 7A, taken through line B-B of FIG. 7A. In FIG. 6, the illustrated design for end disc 64 is compatible with the clutch discs A-G, as they have the same tab design (compare tab 64' with tabs A'-G'). In another embodiment, end disc 64 does not include a tab but is fixed to first clutch disc A for coupled rotation therewith.

The clutch discs A-G may be formed from materials such as metal or plastic using known manufacturing methods such as stamping, casting, injection molding, and machining, for example. Moreover, modifications may be made to save materials, weight, or reduce part shrinkage by, for example, providing recessed portions 70 on discs A-G. In an alternative embodiment, cut-out portions may be provided through discs A-G.

Figure 8A:
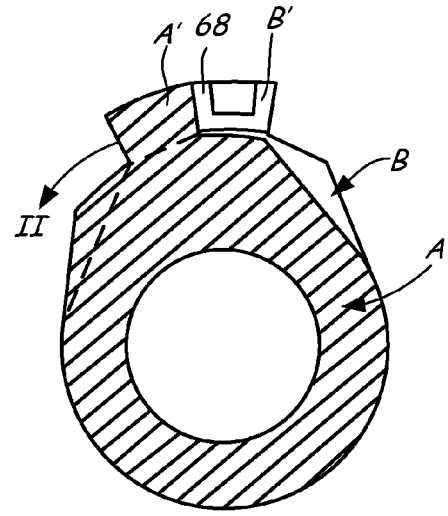
FIG. 8A is a front view of two adjacent disc clutch plates in a first position.
Figure 8B:
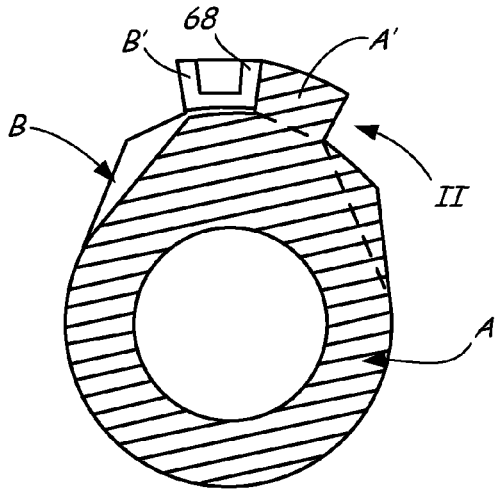
FIG. 8B is a front view of the two adjacent disc clutch plates of FIG. 8A in a second position.
Figure 8C:
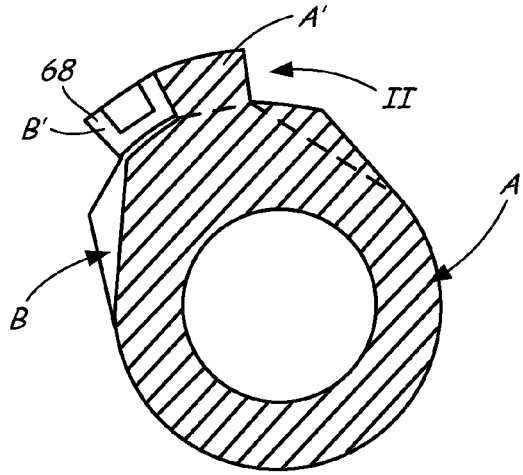
FIG. 8C is a front view of the two adjacent disc clutch plates of FIG. 8A in a third position.

FIGS. 8A-8C illustrate the interaction, in one embodiment, of two adjacent clutch discs such as first clutch disc A and clutch disc B, viewed from line 8-8 of FIGS. 4 and 5. As discussed earlier, end disc 64 rotates with auxiliary spring 54 about shaft 22. In one embodiment (not shown), first clutch disc A rotates with end disc 64. Clutch disc A includes tab A'. During the operation of opening door 12, auxiliary spring 54, end disc 64, and clutch disc A rotate in direction II. Each tab A'-G' includes an axially extending portion 68 for interaction with the tab A'-G' of an adjacent clutch disc (see FIGS. 4, 7B and 8).

FIGS. 3-6 and 8A show an exemplary auxiliary spring assembly 52 configuration when door 12 is closed. As door 12 is opened, auxiliary spring 54 releases its tension by unwinding about shaft 22 in direction II, therefore providing a supplemental lifting force to torsion spring 58 during a portion of the travel of door 12. After the tension in auxiliary spring 54 is released, spring 54 becomes inactive but continues to rotate with shaft 22 in direction II. As that happens, tab A' of disc clutch A rotates in direction II until it contacts axially extending portion 68 of tab B', as shown in FIG. 8B. This causes clutch disc B to rotate with clutch disc A in direction II, as shown in FIG. 8C. After almost a full revolution, tab B' similarly contacts a tab C', causing clutch disc C to also travel in direction II. In a similar manner, each of the clutch discs carries an adjacent clutch disc around shaft 22 in turn until shaft 22 has finished rotating, which occurs when door 12 has been completely lifted. Thus, disc clutch 56 allows auxiliary spring 54 to freely rotate on shaft 22 until door 12 has been completely lifted. In one embodiment, shaft 22 rotates eight times to lift the entire door 12. Thus, disc clutch assembly 56 is designed to provide at least as many revolutions of auxiliary spring 54 as necessary for the door lifting operation. Taller doors may require more revolutions of shaft 22; accordingly, additional clutch discs may be used in disc clutch assembly 56. Once door 12 is fully opened, the clutch disc tabs will be in the opposite order as that shown in FIGS. 3-6 (for example, looking at FIG. 4, tab B' will be in front of tab A', etc.).

In a door closing operation, the clutch discs A-G rotate in an opposite direction I, starting with clutch disc G. After tab G' has made almost one complete rotation, its axially extending portion 68 (shown in FIGS. 4 and 7B) contacts and pushes on tab F' of clutch disc F. Thereafter, clutch discs G and F move together in direction I until axially extending portion 68 of tab F' contacts tab E'. Thereafter, clutch discs G, F and E rotate together in the direction of I until axially extending portion 68 of tab E' contacts tab D'. This proceeds until all of the clutch discs A-G (or however many are in a particular embodiment) have fully rotated in direction I. At that point, the tension that develops in auxiliary spring 54 serves to support the extra weight of door panel section 12*b* as door 12 is lowered, thereby preventing the weight of the door from causing it to fall too quickly at the end of the closing operation.

While the disclosed embodiments illustrate helper spring clutch devices that operate to assist in raising/lowering a heavier top door panel section, it is contemplated that such torsion spring helper assistance could be disposed at any point along the door travel path. For example, if an intermediate door panel section was heavier than other door panel sections, then a helper spring clutch device could be provided to aid in the lifting component of that particular door portion. Alternatively, multiple helper spring clutch devices could be used to provide raising/lowering assistance during different, spaced apart segments of door travel.

Although the auxiliary spring clutch device disclosed herein has been described with respect to several embodiments, workers skilled in the art will recognize that changes may be made in form and detail without departing from the spirit and scope of the disclosure.

The invention claimed is:

1. A spring assembly for an upward acting door that travels on a travel path while opening, the assembly comprising:

a shaft;

a torsion spring connected to the shaft, wherein the torsion spring provides a lifting force for the door throughout the travel path;

a second spring connected to the shaft, wherein the second spring provides a lifting force for the door during only a portion of the travel path; and a plurality of clutch discs that allow the second spring to rotate about the shaft when the second spring is not providing a lifting force for the door.

2. The assembly of claim 1 wherein the portion is adjustable.

3. The assembly of claim 1 wherein:

the door comprises a plurality of sections; and the travel path of the door comprises a vertical path and a horizontal path; and wherein the portion covers at least an amount of the travel path required to lift one of the plurality of sections from the vertical path onto the horizontal path.

4. The assembly of claim 1 wherein each of the plurality of clutch discs comprises an axially extending tab that cooperates with the axially extending tab of an adjacent clutch disc to transfer rotational momentum.

5. The assembly of claim 1 wherein the portion corresponds to a lifting of a top part of the door.

6. The assembly of claim 1 wherein the second spring rotates about the shaft when it does not provide a lifting force for the door as the door travels on the travel path.

7. A spring assembly for an upward acting door that travels on a travel path while closing, the assembly comprising:

a shaft;

a torsion spring connected to the shaft, wherein the torsion spring supports a weight of the door throughout the travel path;

a second spring connected to the shaft, wherein the second spring supports the weight of the door during only a portion of the travel path; and a plurality of clutch discs that allow the second spring to rotate about the shaft when the second spring is not supporting the weight of the door.

8. The assembly of claim 7 wherein the portion is adjustable.

9. The assembly of claim 7 wherein:

the door comprises a plurality of sections; and the travel path of the door comprises a vertical path and a horizontal path; and wherein the portion corresponds to a lowering of at least one of the plurality of sections from the horizontal path onto the vertical path.

10. The assembly of claim 7 wherein each of the plurality of clutch discs comprises an axially extending tab that cooperates with the axially extending tab of an adjacent clutch disc to transfer rotational momentum.

11. The assembly of claim 7 wherein the portion corresponds to a lowering of a top part of the door.

12. The assembly of claim 7 wherein the second spring rotates about the shaft when it does not provide a supporting force for the door as the door travels on the travel path.

* * * * *